US006755068B2

(12) United States Patent
Miyauchi et al.

(10) Patent No.: US 6,755,068 B2
(45) Date of Patent: Jun. 29, 2004

(54) IRONING-DEEP DRAWING PROCESS

(75) Inventors: Kunio Miyauchi, Tokyo (JP); Takayuki Aoki, Gunma-Ken (JP); Ichiro Takahashi, Saitama (JP)

(73) Assignees: Riken, Saitama (JP); Gunma Prefecture, Gunma-ken (JP); We Plan Company, Tokyo (JP)

( * ) Notice: Subject to any disclaimer, the term of this patent is extended or adjusted under 35 U.S.C. 154(b) by 0 days.

(21) Appl. No.: 09/961,166

(22) Filed: Sep. 24, 2001

(65) Prior Publication Data

US 2002/0083754 A1 Jul. 4, 2002

(30) Foreign Application Priority Data

Dec. 28, 2000 (JP) ..... 2000-401245

(51) Int. Cl.[7] ..... B21D 51/26
(52) U.S. Cl. ..... 72/347; 72/379.1; 72/710
(58) Field of Search ..... 72/283, 284, 285, 72/347, 348, 349, 466.8, 710, 379.4

(56) References Cited

U.S. PATENT DOCUMENTS 3,945,231 A * 3/1976 Imazu et al. ..... 72/349
4,726,211 A * 2/1988 Sunaga et al. ..... 72/283

FOREIGN PATENT DOCUMENTS

| | | |
|---|---|---|
| JP | 62-234623 | 10/1987 |
| JP | 63-248521 | 10/1988 |
| JP | 02-046932 | 2/1990 |

* cited by examiner

*Primary Examiner*—Lowell A. Larson
(74) *Attorney, Agent, or Firm*—Birch, Stewart, Kolasch & Birch, LLP

(57) ABSTRACT

A simultaneous two-sided iron-deep drawing process for producing vessels such as metal cans. After being used, the cans can easily be squashed. A difference in height between the inner die and the outer die or the profile radii of the two dies are varied so as to change the longitudinal wall strength of the vessel. The work material is held between the two dies so that both sides are simultaneously ironed and thereby a tubular structure is obtained.

11 Claims, 5 Drawing Sheets

IRONING-DEEP DRAWING PROCESS

BACKGROUND OF THE INVENTION

1. Field of the Invention

The present invention relates to a simultaneous both-sided ironing-deep drawing process, and in particular to an ironing-deep drawing process for controlling the longitudinal residual stress in the wall of ironed-deep drawn articles.

2. Description of the Related Art

In general, the ironing process including the deep drawing process is widely being used for the production of metallic cans for beverages such as beer, juice and gaseous drinks.

It is favorable to completely flatten the used cans for easier recycling procedure, but the cans made by the conventional one-sided ironing process cannot be well flattened manually by women and children but by a special machine.

In addition, the used cans are irregularly squashed by the conventional machine and are very often dangerous to injure the workers in their handling.

On the other hand, there is a different problem that the inner wall of such reinforcement members as shock absorber pipes has a rough surface and should be additionally polished to be of mirror surface.

OBJECTS AND SUMMARY OF THE INVENTION

The present invention has been developed considering the above-described problems in the extent of the conventional ironing technology. The objects of the invention is to provide a both-sided simultaneous ironing-deep drawing process, where vessels like metallic cans are strong enough during service but can easily be flattened by hand or foot squash after service.

Another object of the invention is to provide a both-sided simultaneous ironing-deep drawing process for producing such reinforcement members as shock absorber pipes which are longitudinally strengthened and have mirrored inner surface during the single stroke, while there is induced the residual compressive elastic stress in the circumferential direction.

For achievement of the above-described objects, the simultaneous both-sided ironing-deep drawing process of the present invention has been developed from such points of view as described below. The present inventors developed the both-sided ironing process by adding an inner die to the conventional outer die, and have so far been successful in achieving the mirror surface of inner wall during ironing and have found it possible to change the circumferential residual stress in the wall of the ironed cup (Refer to the Japanese Patent Publication Nos. 2088989, 2663150, and 2539618).

As regards the object of the present invention, it is necessary to investigate a relation between the longitudinal strength of the ironed cup and the relative geometry of outer and inner dies, to make possible the optimal selection of ironing process in relation with the required longitudinal strength of the ironed cup.

Further, the ironing condition is changed by vibrating either outer or inner dies during the ironing process to give additional changes in the residual stress and geometry of the ironed cup wall. Especially the geometrical change of the wall causes the unique point of wall strength to make easier the longitudinal squash of the cup.

In the simultaneous both-sided ironing-deep drawing process placing a work sheet (blank) and ironing the blank simultaneously with the outer and inner dies to prepare a tubular structure, the present invention relates to longitudinal wall strength change of the tubular structure by changing the height difference between the outer and inner dies as well as the die profile radii.

Thus, according to the present invention, for example, it is possible to control the longitudinal compressive resistance of the linear cup wall with the both-sided ironing process.

Furthermore, the present invention provides ring grooves in the wall of tubular structure by vibrating the outer and/or inner dies along the ironing direction, which causes the change of ironing rate and/or bending operation. The number of ring grooves depends on the frequency of vibration.

In other words, according to the present invention, the above-mentioned outer and inner dies are independent of each other, and both or either of them can be vibrated in the longitudinal or lateral direction to obtain the tubular structure with ring grooves.

The present invention can therefore provide the vessels of forcedly ring-grooved wall by vibrating the ironing die(s) in the direction perpendicular to the ironing direction.

The present invention relates to the serial installation of two or more outer and inner dies which can be independent of each other and can realize multi-stepped ironing process. Thus, the work of ironing can be divided to reduce the severity of ironing in each step and make higher the ironing limit.

Besides, according to the present invention, one or more of outer and/or inner dies which are installed in series can be vibrated in the ironing direction. The present invention makes possible to effectively produce the ring grooves in the wall of vessels by vibrating a part of multi-stepped dies.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1(*a*) is the structural outline of the conventional ironing-deep drawing process, and FIG. 1(*b*) the structural outline of the simultaneous both-sided ironing process.

DETAILED DESCRIPTION OF THE PREFERRED EMBODIMENTS

One example of actual performance of the simultaneous both-sided ironing-deep drawing process according to the present invention is explained below in detail with respect to the attached drawings.

Figure 1A:
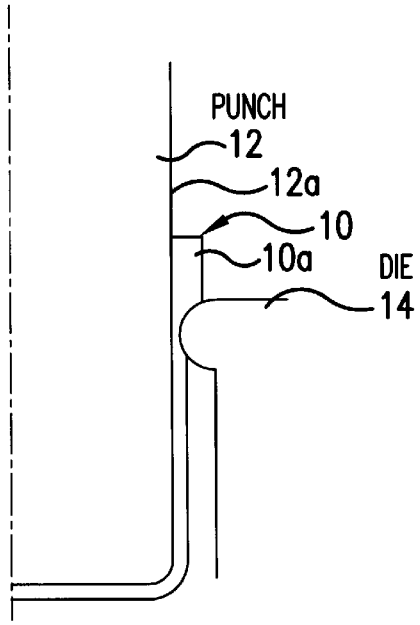
FIG.1A PRIOR ART
FIG. 1 shows the fundamental difference between the conventional ironing-deep drawing process and the simultaneous both-sided ironing-deep drawing process according to the present invention.
Figure 1B:
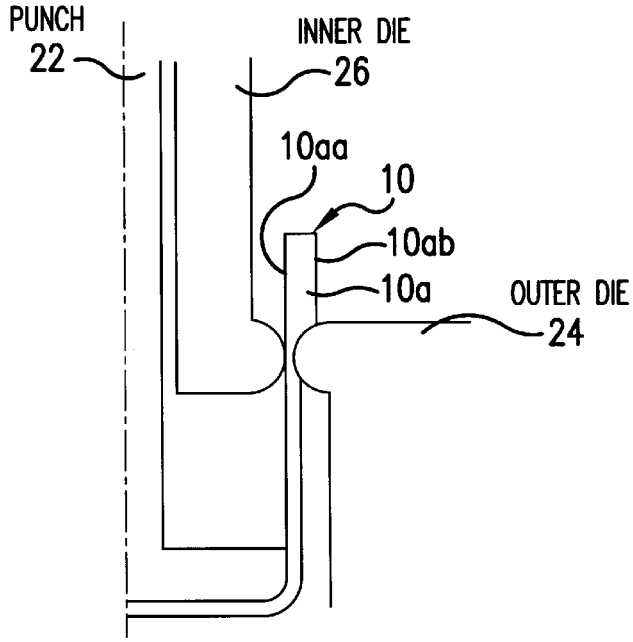

FIG. 1 shows an illustrative comparison of fundamental mechanism and working process between the conventional process and the simultaneous both-sided ironing-deep drawing process according to the present invention. FIG. 1(*a*) illustrates the conventional process, while FIG. 1(*b*) for the process of the present invention.

In the conventional process as shown in FIG. 1(*a*), a work metal 10 like a metallic cup is pushed into a die 14 by a punch 12, and the wall thickness 10*a* of the metal cup 10 is forcedly drawn between the punch 12 and the die 14 which gap (clearance) is smaller than the wall thickness 10*a*, to obtain the ironed cup which has the wall thickness equal to the clearance.

In the conventional process, after having passed through the gap between the punch 12 and the die 14, the wall 10*a* of the cup 10 moves, being sticking to the punch wall 12*a*.

On the other hand, in the simultaneous both-sided ironing-deep drawing process according to the present invention, an inner die 26 is installed between a punch 22 and a die 24 (call an outer die, below), the punch 22 is used only for pushing the cup 10 into the die cavity, and the ironing process is done by the outer die 24 and the newly installed inner die 26.

Herein, the inner wall surface 10*aa* and the outer wall surface 10*ab* are subjected to frictional slide with the inner die 26 and the outer die 24, respectively, to be of mirror surface. Besides, according to the above-described patents, the present inventors have already found it possible to change the circumferential residual stress in the ironed cup wall by changing the profile radii of ironing dies and the height difference between the dies.

This time, the present inventors have found that the longitudinal strength of ironed cups can be controlled by forcedly sliding the inner wall surface 10*aa* and the outer wall surface 10*ab* of the cup 10 on the ironing dies (the inner die 26 and the outer die 24).

Figure 2A:
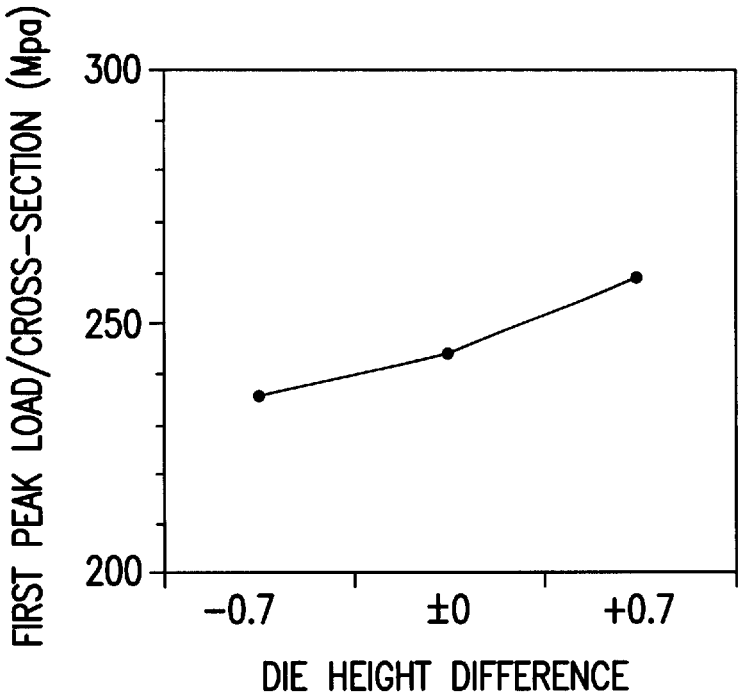
FIG. 2(*a*) is an example of the effect of die height difference between the outer and inner dies on the longitudinal compressive resistance of ironed cups, and FIG. 2(*b*) illustrates the height difference h between the outer and inner dies in the simultaneous both-sided ironing-deep drawing process according to the present invention.
Figure 2B:
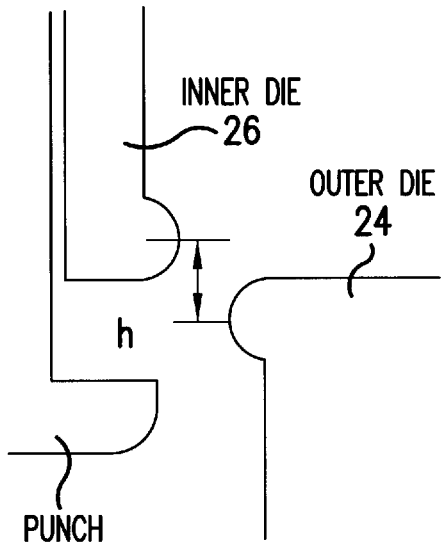

Next, in the ironing-deep drawing process according to the present invention, FIG. 2(*a*) shows an example of the effect of height difference (refer to FIG. 2(*b*)) between the inner die 26 and the outer die 24 on the longitudinal compressive resistance.

The relative position of dies in FIG. 2(*a*) is the height difference h between the inner die 26 and the outer die 24, where h is positive in case of the inner die 26 being higher than the outer die 24, while h is negative if the inner die 26 is lower than the outer die 24.

The longitudinal compressive resistance is represented by the first peak load/wall cross-section (MPa) for the vertical axis in FIG. 2(*a*). As shown in FIG. 2(*a*), we can increase or decrease the longitudinal strength of ironed cups depending on varying request by changing the height difference, that is, h between the inner die 26 and the outer die 24.

Figure 3:
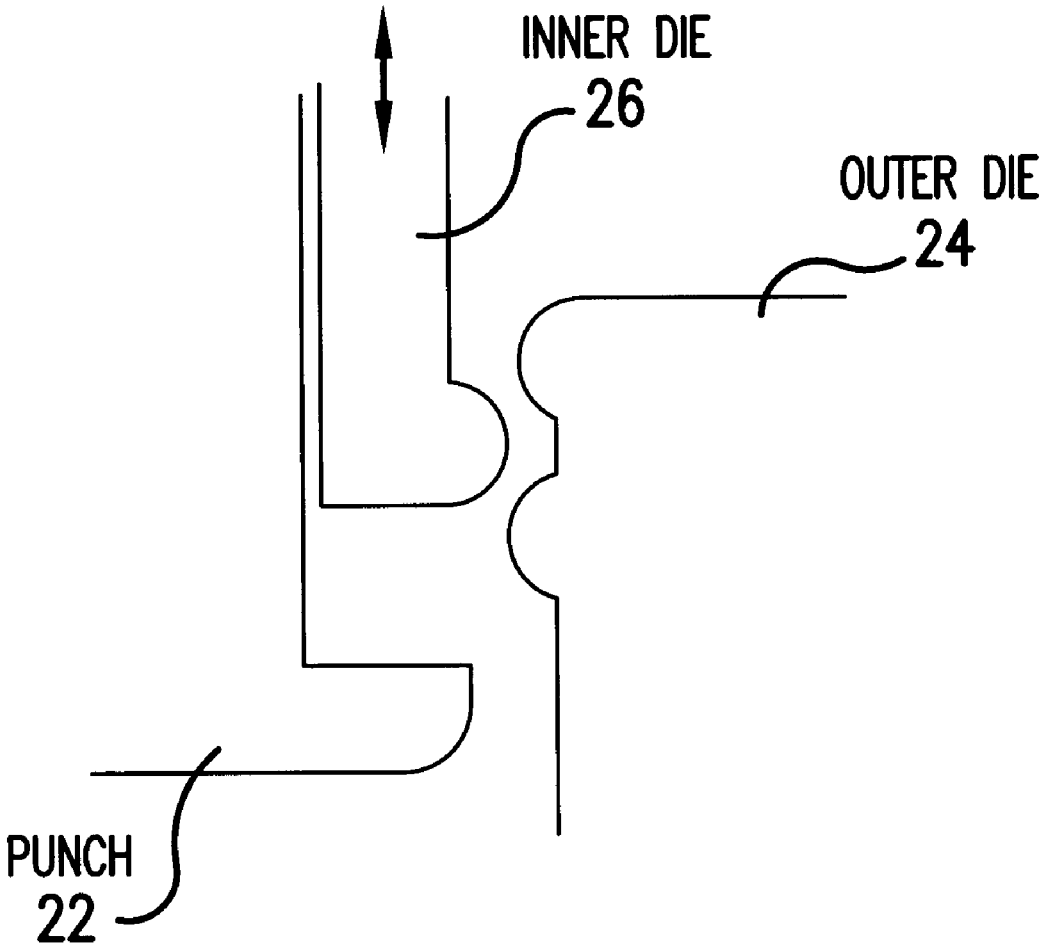
FIG. 3 illustrates the apparatus for changing the height difference between the outer and inner dies, controlling the relation between the vibrating speed and the ironing speed, and continuously forming the ring grooves in the wall of tubular vessels.

Then, FIG. 3 is an illustrative diagram of an apparatus for continuously forming ring grooves in the cup wall 10*a* by changing the relative position between the inner die 26 and the outer die 24 and controlling the vibrating speed and the ironing speed during ironing.

Figure 4B:
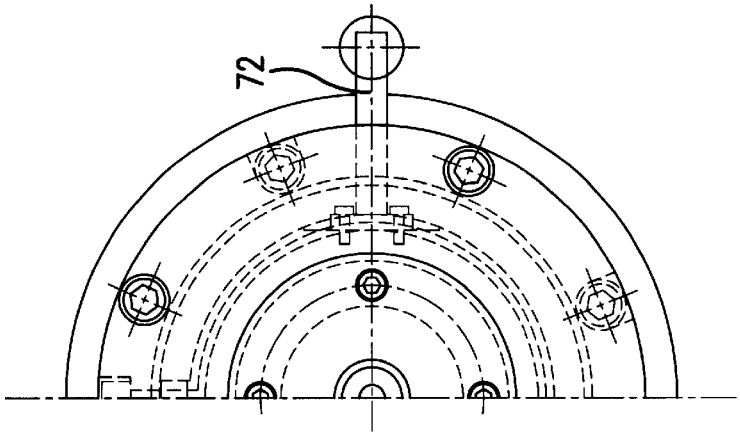
FIG. 4 is a concrete example of the structure of the simultaneous both-sided ironing-deep drawing apparatus vibrating the inner die in the longitudinal (ironing) direction, and FIG. 4(*a*) shows the vertical cross-section of the apparatus and FIG. 4(*b*) is for its lateral cross-section.
Figure 4A:
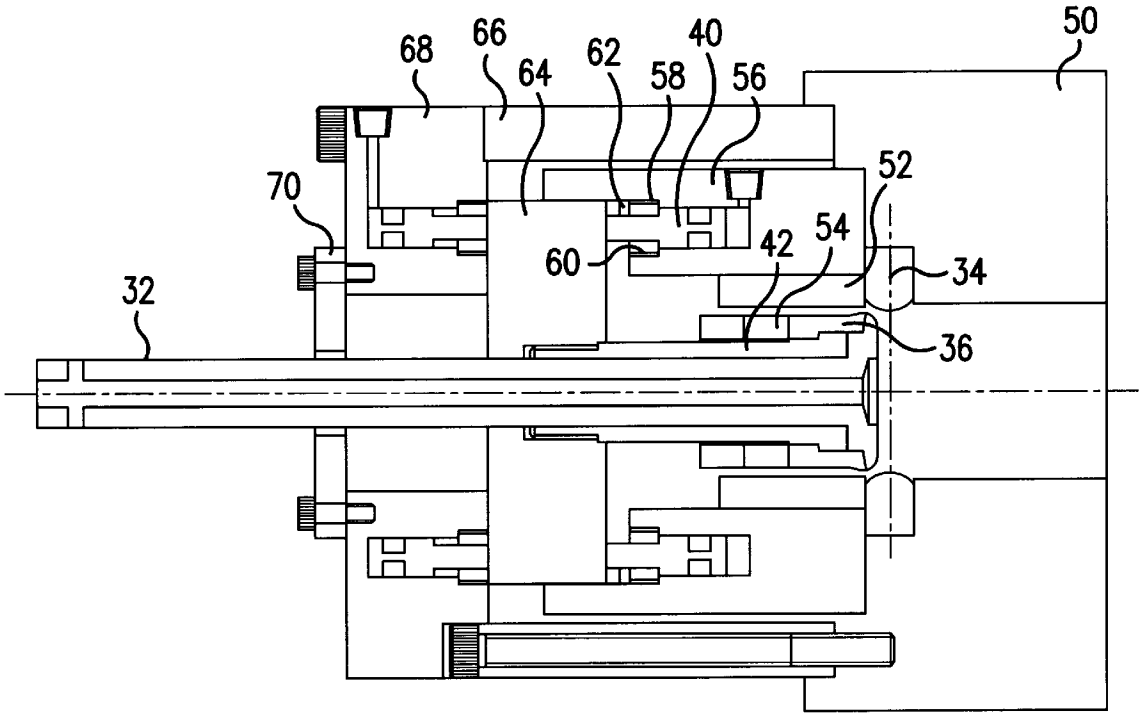

FIG. 4 is one example of the simultaneously both-sided ironing-deep drawing apparatus for vibrating the inner die in the ironing direction, where FIG. 4(*a*) shows the illustrative diagram of the vertical cross-section of the simultaneous both-sided ironing-deep drawing apparatus and FIG. 4(*b*) is for its lateral cross-section.

The apparatus as shown in FIGS. 4(*a*) and (*b*) consists of a base 50, an outer die 34, an inner die 36, a blank support 42, an inner die stopper 54, an inner die holder 42, a lower cylinder 56, a piston 40, piston stoppers 58 and 60, an adjusting spacer 62, an inner die holder 64, a guide ring 66, an upper cylinder 68, a spring stopper 70, a punch 32, and a displacement meter arm 72.

First, after the inner die 36 moves with the punch 32 and reaches the stopping position, the punch 32 only continues to move. During the following ironing operation, the inner die 36 is given a reciprocating motion in the ironing direction, centering at the stopping position. The up-and-down motion of the piston 40 is caused by the switch-over of oil pressure and is transmitted to the inner die 36 through the inner die holder 42, to produce the reciprocating vibration of the inner die 36.

The up-and-down motion of the inner die 36 changes the ironing condition between the inner die 36 and the outer die 34, to form the ring grooves in the wall of ironed cups continuously. The motion of either the inner die 36 of the outer die 34 can result in the same effect.

The ring grooves can more effectively be formed by reciprocating a counter die within the two-throws of the die. Further, the direct formation is made possible by the reciprocating motion of either of the ironing dies in the lateral direction to the direction of punch motion (ironing or longitudinal direction). In this case, however, there is a possibility to increase the cost of production due to a higher difficulty of the controlling technique.

Figure 5:
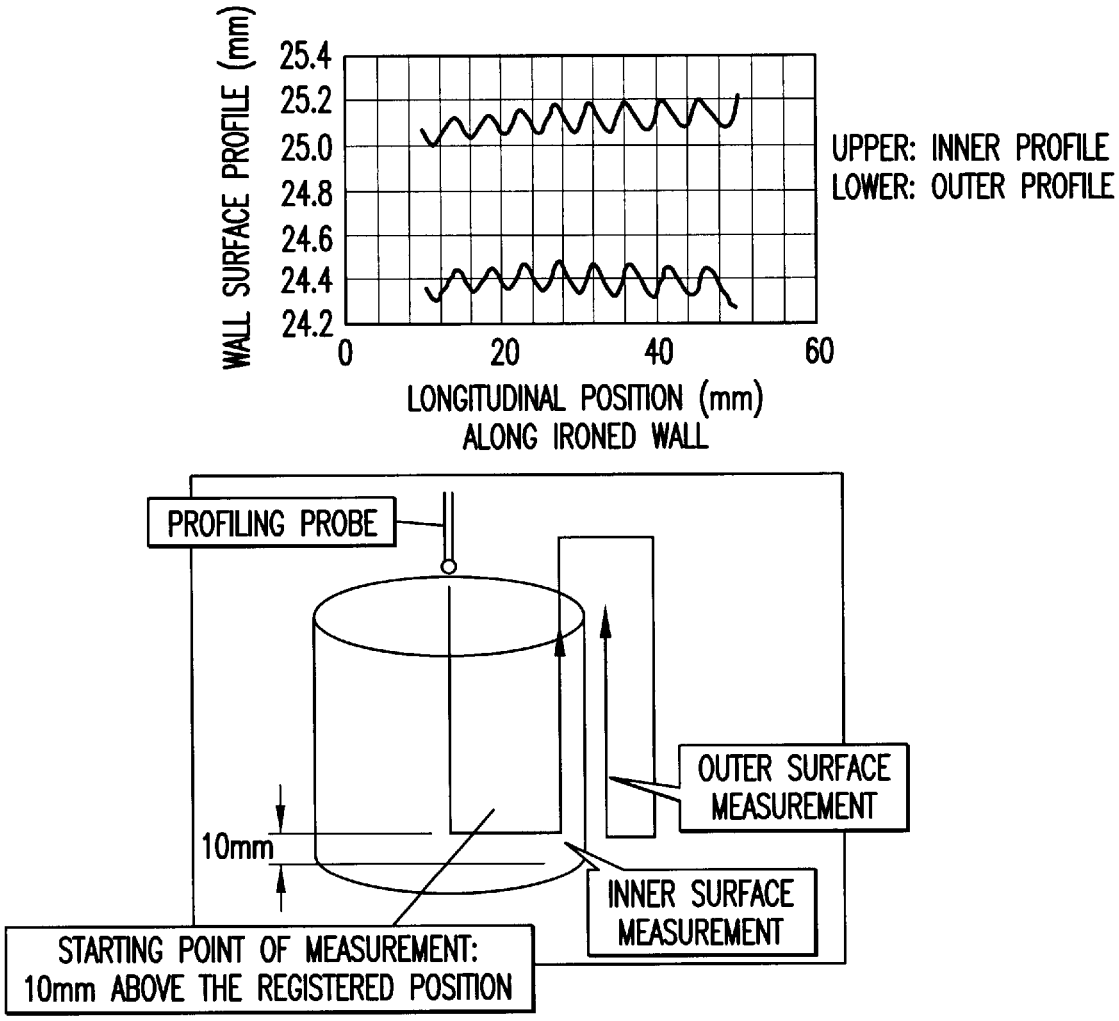
FIG. 5 gives an example for the profile measurement in the longitudinal (ironing) direction of ring-grooved wall, formed by the apparatus as shown in FIG. 4.

FIG. 5 is one example of the profile of ring grooves in the cup wall ironed by the apparatus as shown in FIGS. 4(*a*) and (*b*), obtained by using a three dimensional profile measuring machine.

We have found that the bent part of the grooves formed by the simultaneous both-sided ironing-deep drawing process becomes the unique point of lowest strength and helps easier and fine regular longitudinal squash.

As the composition of the present invention has been explained so far, we can keep the strength of ironed vessels like a metallic can strong enough until we finish to use them and can easily squash used cans with a hand or foot.

As the composition of the present invention has been explained so far, there are excellent effects that the longitudinal strength is increased, the inner wall surface is ironed to be of mirror, and the circumferential elastic compression can remain for the reinforcement member like a shock absorber In more detail, the present invention has the following advantages which can be realized by no conventional ironing process.

(1) The increase of the longitudinal strength of ironed tubular article makes possible the reduction of product weight and the saving of resources.

(2) As the above-described achievement of simultaneous bending and ironing operation can produce the ring grooves in the wall of ironed cups, it becomes very effective for space saving and protection of injury in handling because the most cans including beverage cans, food cans and other industrial cans after having been used can easily be squashed by a relatively small force of hand or foot.

(3) In the production of tubular structure made of materials of low elastic limit, bellows-like structure can be obtained by the single stroke, so the reduction of production cost is also possible.

(4) The effect of improvement resulting from the present invention is available for a very wide extent of our society. For example, several ten billions of beverage cans are consumed a year in Japan. As the rationalization of recycling process is so important in the future society that the present invention will largely benefit the environmental problems in the world.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, all changes that come within the meaning and range of equivalents thereof are intended to be embraced therein.

The entire disclosure of Japanese Patent Application No. 2000-401245 filed on Dec. 28, 2000 including specification, claims, drawings and summary are incorporated herein by reference in its entirety.

What is claimed is:

1. A process for ironing and deep drawing simultaneously on two sides, comprising:

providing an inner die and an outer die;

providing a height difference between said inner die and said outer die;

drawing a work material between said inner die and said outer die;

changing said height difference and/or changing a profile radius of one of said inner and outer dies while drawing said work material to control a longitudinal wall strength of a produced tubular structure to cyclically vary along said sides; and ironing both sides of said work material thereby.

2. The process according to claim 1, further comprising:

vibrating at least one of said inner and outer dies in an ironing direction so as to produce a change in the ironing rate and/or bending, and to produce ring grooves in a wall of said tubular structures.

3. The process according to claim 2, further comprising:

vibrating said inner and outer dies in a lateral direction perpendicular to an ironing direction, thereby producing ring grooves in a wall of said tubular structure.

4. The process according to claim 3, further comprising:

providing a plurality of sets of inner and outer dies successively along an ironing path; and vibrating at least one of the dies in an ironing direction.

5. The method according to claim 2, further comprising performing a multi-stepped ironing using two or more sets of inner and outer dies along an ironing path.

6. The process according to claim 2, further comprising:

providing a plurality of sets of inner and outer dies successively along an ironing path; and vibrating at least one of the dies in an ironing direction.

7. The process according to claim 1 further comprising:

vibrating said inner and outer dies in a lateral direction perpendicular to an ironing direction, thereby producing ring grooves in a wall of said tubular structure.

8. The method according to claim 7, further comprising performing a multi-stepped ironing using two or more sets of inner and outer dies along an ironing path.

9. The process according to claim 7, further comprising:

providing a plurality of sets of inner and outer dies successively along an ironing path; and vibrating at least one of the dies in an ironing direction.

10. The method according to claim 1, further comprising performing a multi-stepped ironing using two or more sets of inner and outer dies along an ironing path.

11. The process according to claims 1, further comprising:

providing a plurality of sets of inner and outer dies successively along an ironing path; and vibrating at least one of the dies in an ironing direction.

* * * * *